US011795706B2

(12) United States Patent
Ayers

(10) Patent No.: US 11,795,706 B2
(45) Date of Patent: Oct. 24, 2023

(54) STRUCTURE INSPECTION AND ACCESS DEVICE

(71) Applicant: William Roger Ayers, Essex, MD (US)

(72) Inventor: William Roger Ayers, Essex, MD (US)

( * ) Notice: Subject to any disclaimer, the term of this patent is extended or adjusted under 35 U.S.C. 154(b) by 8 days.

(21) Appl. No.: 17/496,077

(22) Filed: Oct. 7, 2021

(65) Prior Publication Data

US 2023/0112254 A1 Apr. 13, 2023

(51) Int. Cl.
*E04F 19/08* (2006.01)

(52) U.S. Cl.
CPC ..... *E04F 19/08* (2013.01)

(58) Field of Classification Search
CPC ..... E04G 15/061; F16L 5/02; E04B 1/947; E04F 19/08
See application file for complete search history.

(56) References Cited

U.S. PATENT DOCUMENTS 1,746,696 A * 2/1930 Dows ..... E04G 15/061 249/177
1,898,117 A * 2/1933 Boosey ..... E04F 19/08 169/70
4,967,524 A * 11/1990 Hull ..... B60R 15/00 52/220.8
6,969,799 B2 * 11/2005 Snyder ..... H02G 3/22 52/220.8
8,209,923 B1 * 7/2012 Rich ..... E04D 13/1476 454/366
9,045,932 B2 * 6/2015 Laukhuf ..... H02B 1/305
9,255,412 B2 * 2/2016 Haynes ..... E04D 13/1407
11,246,303 B2 * 2/2022 Bost ..... A01M 1/02
11,448,344 B2 * 9/2022 Gilstrap ..... F16L 5/14
11,460,128 B1 * 10/2022 Gretz ..... F16L 3/123
2008/0084032 A1 * 4/2008 Cravens ..... F16L 5/02 277/609
2008/0135285 A1 * 6/2008 Drane ..... H02G 3/0493 174/483
2008/0135286 A1 * 6/2008 Jolly ..... H02G 3/185 174/483
2012/0297572 A1 * 11/2012 Stewart ..... F16L 5/02 16/2.2
2013/0234404 A1 * 9/2013 Coscarella ..... F16L 5/02 277/606
2013/0257039 A1 * 10/2013 Bibbo ..... F16L 5/02 285/139.3
2015/0218799 A1 * 8/2015 Coscarella ..... F16L 5/02 52/404.1
2015/0323103 A1 * 11/2015 Coscarella ..... F16L 5/10 277/606
2018/0015314 A1 * 1/2018 Muenzenberger ..... H02G 3/22
2018/0112803 A1 * 4/2018 Muenzenberger ..... A62C 3/16
2018/0209205 A1 * 7/2018 Gilleran ..... H02G 3/10
2020/0332519 A1 * 10/2020 Gandolfo ..... E04B 1/66
2021/0037803 A1 * 2/2021 Bost ..... A01M 23/005
2021/0148489 A1 * 5/2021 Gilstrap ..... F16L 5/10
2022/0275636 A1 * 9/2022 Gilstrap ..... E04B 1/66

* cited by examiner

*Primary Examiner* — Gisele D Ford
(74) *Attorney, Agent, or Firm* — Maier & Maier, PLLC

(57) ABSTRACT

A structure inspection and access device. The device includes a faceplate attachable to a structure, the faceplate having a front face and a rear face, an access aperture defined in the faceplate, the access aperture being selectively closeable by a cover, a tube having a proximal end in communication with the access aperture and extending in a distal direction from the rear face of the faceplate, and a valve disposed at a distal end of the tube.

10 Claims, 3 Drawing Sheets

STRUCTURE INSPECTION AND ACCESS DEVICE

BACKGROUND

The void space behind drywall in most modern structures is typically difficult to access. However, in certain situations, easy and repeated access to this void space is necessary. For example, in a pest control situation, a technician may need to access the void space to observe whether any pests are present, to remove any expired pests, and to treat the area with pesticide. Furthermore, such access may be needed on repeated occasions; however, it is impractical and unsightly to continually have exposed access to the void space. A simple, re-closable, and aesthetically pleasing way to access the void space is therefore desired.

SUMMARY

According to at least one exemplary embodiment, a structure inspection and access device is disclosed. The device can include a faceplate attachable to a structure, the faceplate having a front face and a rear face, an access aperture defined in the faceplate. The access aperture can be selectively closeable by a cover. A tube having a proximal end in communication with the access aperture extends in a distal direction from the rear face of the faceplate. A valve is disposed at a distal end of the tube. When the faceplate is attached to the structure, the tube extends through an aperture defined in the structure so as to access a void space behind the structure.

According to another exemplary embodiment, a structure inspection and access method is disclosed. The method can include defining an aperture in a structure, positioning a tube of a structure inspection and access device within the aperture such that the tube extends into a void space behind the structure, attaching the structure inspection and access device to the structure by coupling a faceplate of the device to the structure, positioning an implement in the tube via an access aperture defined in the faceplate and in communication with a proximal end of the tube, extending the implement through the tube so as to open a valve disposed at a distal end of the tube, accessing the void space by extending the implement past the valve and the distal end of the tube, and withdrawing the implement from the void space and the tube. The method can further include opening a cover of the access aperture prior to positioning an implement in the tube and closing the cover after withdrawing the implement from the tube.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a structure inspection device is disclosed. The structure inspection and access device may be attachable to a structure such as a drywall or a panel, and can provide an aperture via which the void space behind the drywall may be inspected. The structure inspection and access device can include a faceplate, a tube extending into the void space, a valve disposed at a distal end of the tube, and a cover disposed at a proximal end of the tube.

Figure 1:
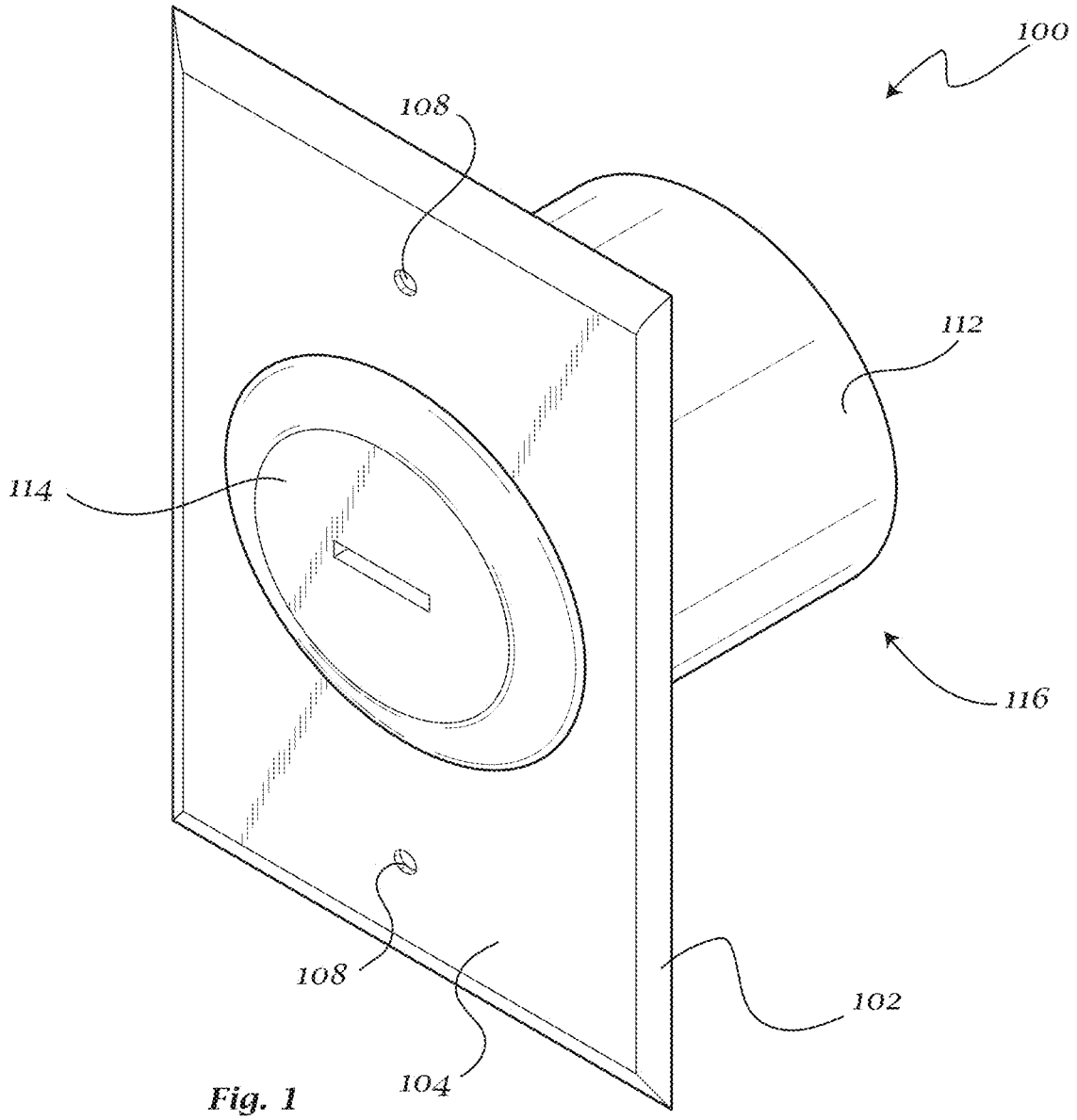
FIG. 1 is a front perspective view of a structure inspection and access device.
Figure 2:
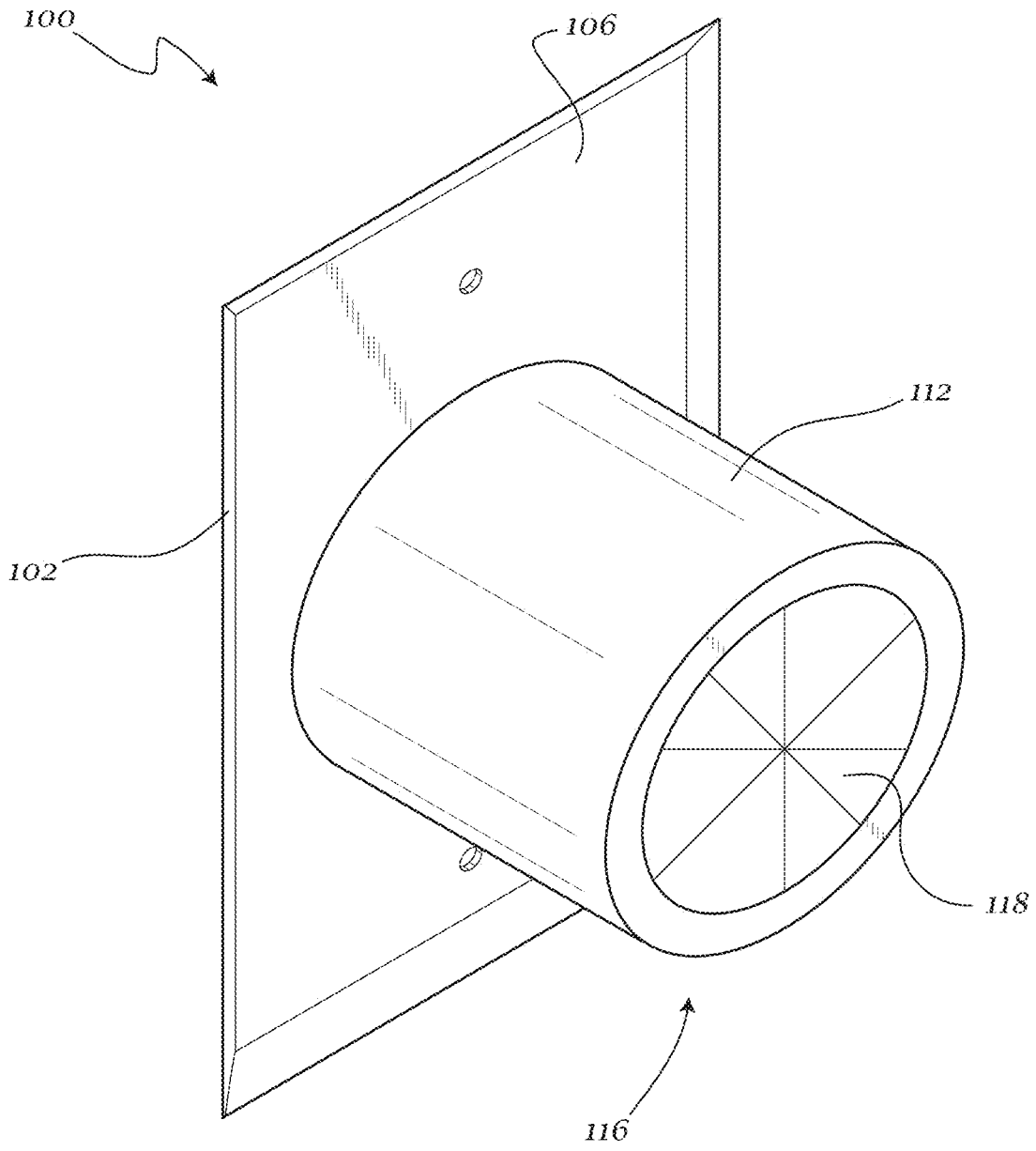
FIG. 2 is a rear perspective view of a structure inspection and access device.
Figure 3:
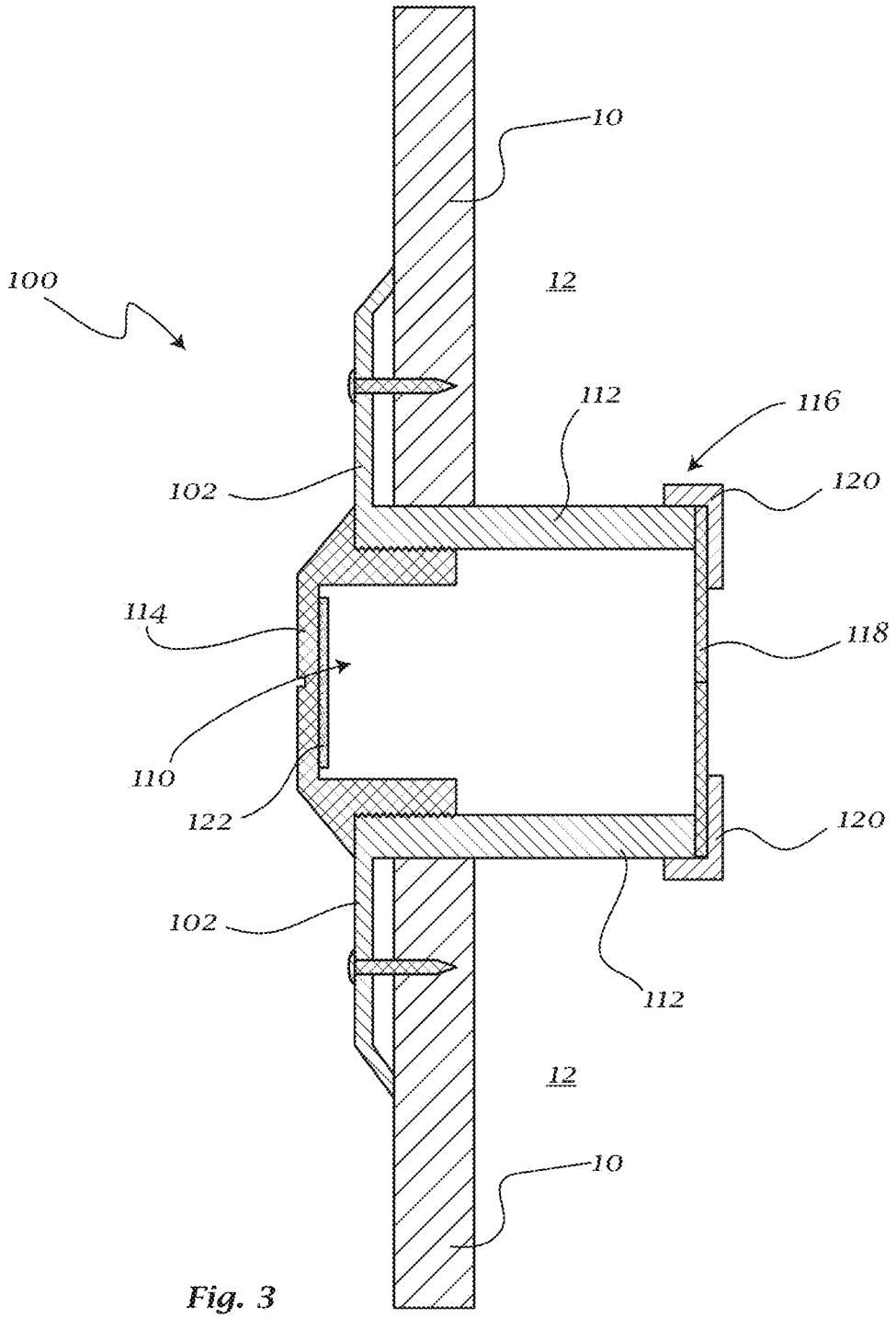
FIG. 3 is a cross-sectional view along the central vertical plane of a structure inspection and access device attached to a structure.

FIGS. 1-3 show an exemplary embodiment of a structure inspection and access device 100. Structure inspection and access device 100 can include a faceplate 102, which may be sized and shaped as a standard wall plate for an electrical outlet or a light switch. Faceplate 102 has a proximal face 104 facing outwardly from the wall 10 and a distal face 106 facing toward the wall 10. Exemplary dimensions for wall plate 102 may be 2.75 in ×4.5 in; however, any dimensions and shapes that enable device 100 to function as described herein may be contemplated and provided as desired. Faceplate 102 can further have one or more fastener apertures 108 defined therethrough, via which device 100 may be attached to a wall, by use of threaded or other fasteners.

Defined through faceplate 102, for example substantially at the center thereof, may be access aperture 110. A tube 112 may extend from the distal face 106 of faceplate 102 and may be in communication with access aperture 110. Access aperture 110 may be provided with a cap or cover 114, which may be a threaded cap, a flip cap, a friction fit cap, or any other covering that enables device 100 to function as described herein. Coupling structures for attaching and detaching cover 114 may be contemplated and provided as desired on faceplate 102 or within tube 112, according to the type of cover 114 being used. In some exemplary embodiments, cover 108 and its corresponding coupling structures may include child-proofing elements. In further exemplary embodiments, cover 108 may include one or more slots 109 defined therein, allowing cover 108 to be rotated by a screwdriver.

Tube 112 may extend in a distal direction from faceplate 102, such that, when device 100 is affixed to a wall panel, tube 112 extends into the void space 12 behind the wall panel 10. Exemplary measurements for tube 112 may be a length of 1.5 in and a diameter of 2.0 in; however, any dimensions that enable device 100 to function as described herein may be contemplated and provided as desired. The radius of aperture 110 may correspond to the radius of tube 112. In the exemplary embodiment, tube 112 is shown as having a linear configuration; however, tube 112 may be provided with bends, joints, or other modifications as desired based on the configuration of the void space.

Disposed at the distal end 116 of tube 112 may be a valve 118. Valve 118 may be, for example, a cross slit valve, a flap valve, or any other type of valve that enables device 100 to function as described herein. Valve 118 may be formed from a resilient material such as rubber or silicone, a rigid material, or any other material that enables valve 118 to function as described herein. In some exemplary embodiments, valve 118 may be a dust guard formed from bristles. Valve 118 may be coupled to tube 112 in any desired manner, for example via adhesives, or by a cap 120 that couples to the distal end of tube 112 by threaded coupling, friction fit, or any other manner. Valve 118, in an open position, may allow an inspection device, such as a borescope, flexible claw tool, or pesticide duster, to pass through valve 118 and beyond distal end 116, and into the void space 12 behind the drywall 10. In a closed position, valve 118 may prevent dust, dirt, and other matter from passing from the void space 12 into tube 112.

In some exemplary embodiments, cover 114 may include a replaceable adhesive chip 122 removably attachable to the distal face of cover 114. Adhesive chip 122 can include an adhesive surface of sufficient strength to capture insects that come in contact with the adhesive surface, thereby allowing a user to identify insects that pass into tube 112 from the void space behind the wall.

In operation, a user may create an aperture in a drywall 10, and affix device 100 to the drywall such that tube 112 passes through the aperture into the void space 12 behind the drywall. When it is desired to inspect or otherwise access the void space, the user may remove cover 114 and insert a borescope, flexible claw tool, pesticide duster, or any other suitable implement into tube 112. Pushing the implement against valve 118 may open the valve, allowing the implement to pass into the void space. After the implement is withdrawn from the void space, valve 118 may close, thereby preventing matter from the void space from passing into tube 112. At the end of use, cover 114 may be replaced, and device 100 may be left affixed to the wall so as to allow easy and simple subsequent access.

While the structure inspection and access device 100 has been described herein with reference to a structure such as a wall or drywall, it should be appreciated that the structure inspection and access device may be used in any situation where it is desirable to have repeated, convenient, and coverable access to an otherwise difficult-to-access space behind a structure.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A structure inspection and access method, comprising:
defining an aperture in a structure;
positioning a tube of a structure inspection and access device within the aperture such that the tube extends into a void space behind the structure;
attaching the structure inspection and access device to the structure by coupling a faceplate of the device to the structure;
positioning an implement in the tube via an access aperture defined in the faceplate and in communication with a proximal end of the tube;
extending the implement through the tube so as to open a valve disposed at a distal end of the tube;
accessing the void space by extending the implement past the valve and the distal end of the tube; and
withdrawing the implement from the void space and the tube, wherein
the void space comprises an interior space between a first face of the structure and a second face of the structure.

2. The method of claim 1, further comprising opening a cover of the access aperture prior to positioning the implement in the tube and closing the cover after withdrawing the implement from the tube.

3. The method of claim 1, wherein the implement is one of a borescope, a flexible claw tool, or a pesticide duster.

4. The method of claim 1, wherein the structure is a wall.

5. The method of claim 1, wherein the structure is a drywall.

6. The method of claim 1, wherein the valve is a cross-slit valve.

7. The method of claim 1, wherein the valve is a flap valve.

8. The method of claim 1, further comprising an adhesive chip disposed on a face of the cover that faces the access aperture.

9. The method of claim 2, further comprising a slot defined in the cover.

10. The method of claim 2, wherein the cover includes child-proofing elements.

* * * * *